US006119759A

United States Patent [19]

Assaad

[11] Patent Number: 6,119,759

[45] Date of Patent: Sep. 19, 2000

[54] OPENING AND CLOSING DEVICE FOR USE WITH A SHUTTER SYSTEM FOR PROTECTING A BUILDING SPACE

[76] Inventor: Elie Assaad, 700 rue de la Marchanderie Zi Croix de Metz, 54200 Toul, France

[21] Appl. No.: 09/171,126

[22] PCT Filed: Apr. 11, 1997

[86] PCT No.: PCT/FR97/00643

§ 371 Date: Mar. 23, 1999

§ 102(e) Date: Mar. 23, 1999

[87] PCT Pub. No.: WO97/38202

PCT Pub. Date: Oct. 16, 1997

[30] Foreign Application Priority Data

Apr. 11, 1996 [FR] France ..... 96 04699

[51] Int. Cl.[7] ..... E06B 9/15

[52] U.S. Cl. ..... 160/310; 160/133

[58] Field of Search ..... 160/133, 236, 160/310, 311, 188, 1, 7, 32, 33, 185

[56] References Cited

U.S. PATENT DOCUMENTS

| | | | |
|---|---|---|---|
| 1,639,474 | 8/1927 | Whitmore | 160/236 |
| 2,068,977 | 1/1937 | Dodge | 160/236 |
| 2,572,957 | 10/1951 | Shaw | 160/236 X |
| 2,912,048 | 11/1959 | Grau | 160/133 |
| 3,302,692 | 2/1967 | Grau | 160/133 |
| 3,989,084 | 11/1976 | Inamura et al. | 160/133 X |
| 4,292,763 | 10/1981 | Barnes et al. . | |
| 4,665,965 | 5/1987 | Pasquier et al. | 160/133 X |
| 5,392,577 | 2/1995 | D'Onofrio, Jr. et al. . | |
| 5,435,371 | 7/1995 | Cheng | 160/133 |
| 5,566,737 | 10/1996 | Erber | 160/133 |
| 5,687,785 | 11/1997 | Erber et al. | 160/236 |

FOREIGN PATENT DOCUMENTS

| | | |
|---|---|---|
| 0189091 | 7/1986 | European Pat. Off. . |
| 1076329 | 10/1954 | France . |
| 1223764 | 6/1960 | France . |
| 2518046 | 11/1976 | Germany . |
| 3017179 | 11/1981 | Germany . |
| 3114821 | 10/1982 | Germany . |
| 3225568 | 1/1984 | Germany . |
| 287147 | 3/1953 | Switzerland . |
| 419543 | 3/1967 | Switzerland . |

*Primary Examiner*—David M. Purol
*Attorney, Agent, or Firm*—Gary M. Cohen

[57] ABSTRACT

An opening and closing device for use with a shutter system for protecting a building space, such as a slat-type roller blind for a window, includes a series of slats capable of sliding in two generally vertical, laterally positioned guides (4). The slats are hooked to each other by hooking systems (7), and include a male/female interlocking system along their length. The device can be used to lower or raise the shutter system to close or open the protected space, moving between a totally closed position and a partially or fully opened position. In the closed position, the lower slat rests against a horizontal surface and the slats are interlocked with one another along their length to form a continuous sheet. In the partially or fully opened position, the slats are disengaged and separated from each other by a space determined by the height of the hooking system (7). Mirrored elements (20) can be attached to the faces of at least some of the slats to give bottom floors of the protected space maximum natural illumination while the space remains completely private, and to illuminate upper floors by altering the openings of the slats so that incoming light can be inhibited and/or diffused. This permits regulation of the internal temperature of the building responsive to the openings of the slats. When the slats are completely closed, the internal surface of the shutter system forms a mirror capable of saving a considerable amount of energy.

20 Claims, 6 Drawing Sheets

OPENING AND CLOSING DEVICE FOR USE WITH A SHUTTER SYSTEM FOR PROTECTING A BUILDING SPACE

BACKGROUND OF THE INVENTION

The present invention generally relates to a novel opening and closing device for protecting a defined building space which can be used, for example, on folding shutters, sliding doors, roller shutters and similar structures.

As an example, roller-type shutters are often used to protect a defined building space. Such roller-type shutters are generally comprised of plural slats which are fixed to one another by a system of hinges to form a sheet which is capable of sliding within two lateral guides. The resulting sheet is wound around a drum, which is generally located at the top of a window or some other aperture for delimiting the building space, making it possible to completely open the roller-type shutters.

Such roller-type shutters are closed by slowly unwinding the sheet which has been wound on the drum, making it possible for the slats to slide in the lateral guides. The slats are not made pivotable so as to better carry out the closing operation.

An object of the present invention is to provide slats for such shutters which are capable of pivoting on themselves, which has been found to provide additional and useful operating functions.

SUMMARY OF THE INVENTION

This and other objects are achieved in accordance with the present invention by fastening mirror strips or equivalent elements to the slats which form the shutters, and by permitting the slats to selectively pivot on themselves. This has been found to provide the following additional functionality.

Using such strips or equivalent elements on the slats of a roller-type structure provided for the lower stories of a building allows the natural lighting within the building to be maximized by virtue of the reflective properties of the strips, while at the same time maintaining complete privacy for the enclosed space (i.e., room). The intensity of the lighting and the degree of privacy can be adjusted by rotation of the slats.

Using such strips or equivalent elements on the slats of a roller-type structure provided for the upper stories of a building allows lighting to be provided on demand by varying the pivoting angle for the strips, which then function both as a beam inhibitor and/or a beam diffuser. In this way it is made possible to regulate the internal temperature of the protected building space from the inside (e.g., with only a few slats exposed to the sun being opened) and to maintain the coolness of the interior space.

In both cases, when the shutters are completely closed, the shutters form a mirror over approximately the entire inner surface, giving the illusion of space and a pleasant view while at the same time adding an attractive decoration to the interior space. In addition, by making it possible to accommodate the strips and the motor, the relatively thick slats contribute to the reduction of annoying noise and at the same time offer high thermal resistance to heat and cold. Moreover, an appreciable saving of energy is achieved and there is no longer any need to use curtains.

U.S. Pat. No. 5,392,577 describes a door having inclined slats which carry mirror elements. However, the disclosed slats are stationary, and it is impossible to adjust the lighting and temperature.

The present invention provides an improved closing and opening device for a building space, such as a roller-type shutter for a window, having slats which can slide in two vertically extending, lateral guides and which are attached to one another by an attachment system comprising a male/female interlocking system extending along the length of the slats so that the slats can be lowered or raised, to close or open the given space. The slats are movable between a closed and an opened position. When in a completely closed position, the lowermost slat comes to rest on a horizontal surface and the slats are all caused to interlock with one another over their entire length to form a continuous sheet. When in a partially or completely open position, the slats are disengaged and separated from one another by a space defined by the height of the overall system. In accordance with the present invention, at least some slats of the device have a pivoting part, a mirror strip is fastened on one of the faces of the pivoting part, and drive means are provided for selective pivoting of the pivoting parts. In an alternative embodiment of the present invention, the drive means for pivoting the shafts of the pivoting parts are motorized. In another alternative embodiment of the present invention, the shafts of the pivoting parts are pivoted using a wire/pulley system.

The present invention will be better understood with reference to the description of a preferred closing and opening device which is provided below, which is given for the example of a roller-type shutter, together with the following figures.

DETAILED DESCRIPTION OF A PREFERRED EMBODIMENT

A first embodiment of a series of slats which are operable with a motorized pivoting system is shown in FIGS. 1 to 18. In this configuration, the slats combine to form a roller-type shutter system, which may be used to implement a system of folding shutters, sliding doors, gates or, in general, as the sub-elements of a device for "closing" and/or "opening" a desired building space.

Figure 1:
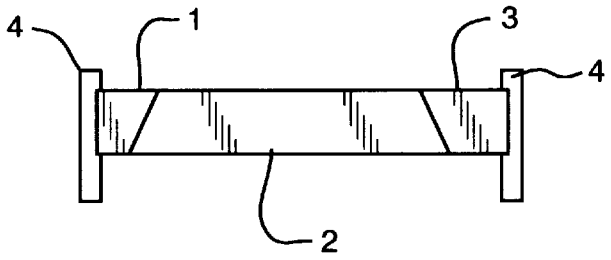
FIG. 1 is an elevational view of a first embodiment of a slat of the present invention.

Referring to FIG. 1, each of the slats is divided into three parts including a central part (2) having a trapezoidal shape, and two lateral parts (1 and 3). The lateral parts (1 and 3) slide in two vertically oriented, lateral guides (4), in each case forming a half-trapezium.

The slats are provided with such a shape for the following purposes. Such a shape allows the central part (2) of the slat to be completely free from any lateral friction, making it possible to pivot the slat with minimum energy. Such a shape also operates to prevent the central part (2) of the slat from executing complete revolutions on itself, to limit the maximum angle of rotation as a function of the internal angles of the trapezium of the central part (2) of the slat, to give the slats an overall rigidity which is resistant to vandalism, when closed, by means of the interlocking system which will be described below, and to eliminate the effects of expansion caused by heat on the central parts.

As an example, the shape of the central part (2) is a trapezium and the two lateral parts (1 and 3) are in the form of a half-trapezium. These shapes can have many variations in terms of their thickness, the weight of the material used or the type of decoration required. For example, the three parts (1, 2 or 3) can be formed as rectangles, two trapezia on the same slat, or one trapezium with rounded portions, etc.

Figure 2A:
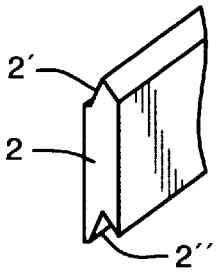
FIGS. 2*a* and 2*b* are vertical cross-sectional views showing different configurations for the slat shown in FIG. 1.

FIG. 2*a* shows a vertical section of the slat. The illustrated slat 2 has a solid triangle 2' formed on the upper side of the slat and an empty triangle 2" formed on the lower side of the slat. Variations of this form are possible, depending on the thickness of the slat and the material from which the slat is formed. As nonlimiting examples, this can include shapes in the form of double, triple or plural triangles, shapes in the form of a trapezium, a double trapezium, or plural trapezia, shapes in the form of a semicircle, a double semicircle, or plural semicircles (see, for example, the slat 2'" shown in FIG. 2*b*), or, more generally, any form of male/female or female/male interlocking connection of the slats. It should be noted that the lower and upper sides may be reversed.

Figure 2B:
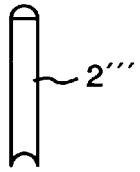
Figure 3A:
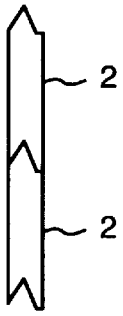
FIGS. 3*a* and 3*b* are vertical cross-sectional views showing the cooperation of the interlocking slats of FIGS. 2*a* and 2*b*.
Figure 3B:
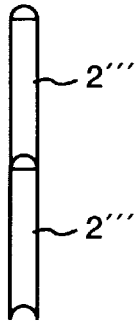

FIGS. 3*a* and 3*b* show, as nonlimiting examples, two possible forms of the horizontal interlocking of the slats shown in FIGS. 2*a* and 2*b*. Many variations of these interlocking structures can be used, as mentioned above.

Figure 4:
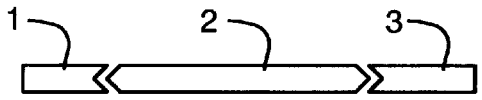
FIG. 4 is a schematic diagram showing vertical interlocking of the slats.

FIG. 4 shows a top view of the vertical interlocking engagement between the three adjacent sub-assemblies of a slat (1, 2 and 3). The ends of these parts are formed as cooperating solid and empty triangles, which are shown merely as an example. As mentioned above, variants of this form may be adopted. Moreover, in general, any form of interlocking structure may be used for a similar purpose.

Figure 5:
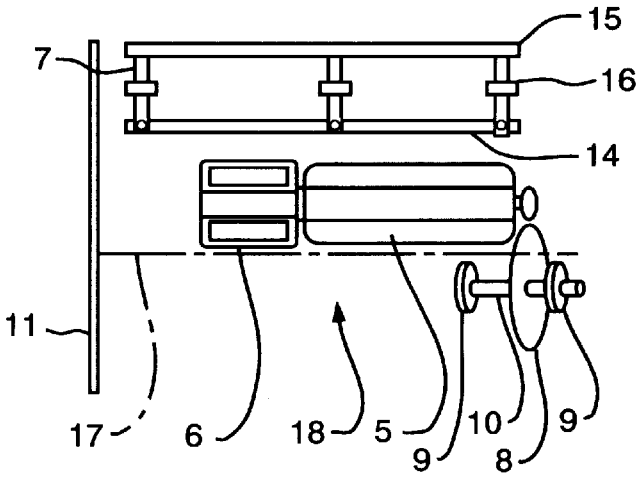
FIG. 5 is an example of a device for motorized pivoting of the slats.

FIG. 5 shows the essential parts of a drive system (18) for the motorized pivoting of a slat. The drive system (18) generally comprises an electric motor (5) which is capable of rotation in both directions to open and close the central part (2) of each slat, an electromagnetic position brake (6), an attachment assembly (7) which serves to connect the parts (1) and (3), a stress reduction system (8), fastening bearings (9), a drive shaft (10), and a sleeve (11) for passing electric wires through the parts (1) and (3) of the slats. The drive system (18) may also be installed or housed in the central part (2) of the slat shown in FIG. 1, which is one of the many possible variants for the location of this system.

Figure 6:
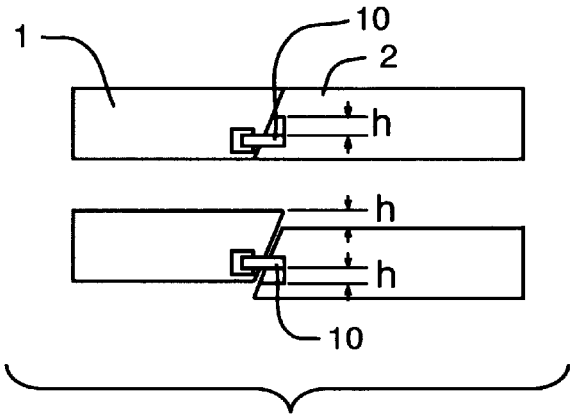
FIG. 6 is a more detailed view of the pivot shaft of the device of FIG. 5.

FIG. 6 shows the degree of freedom of one end of the shaft (10) in the central part (2). The other end of the shaft (10) is fastened in the part (1). Vertical translational movement of the lateral part (1) relative to the central part (2) by an amount (h) results in a dislocation or offset (h) of the slats.

Figure 7:
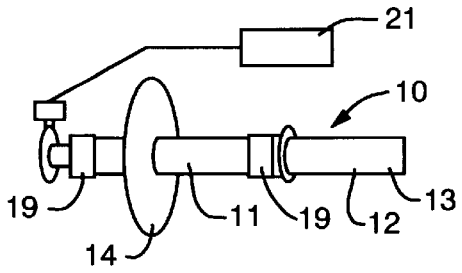
FIG. 7 is a more detailed view of the drive shaft of the device of FIG. 5.

FIG. 7 shows the drive shaft (10), which includes an internally hollow cylindrical part (11), a flat part (12) which is perforated from the inside for allowing electric wires to pass through and which is engaged with the central part (2) of the slat, a clip (13) for attaching the central part (2) to the lateral part (1), which will also serve to attach the lateral part (3) to the central part (2), two bearings (19), and a gearwheel (14) which is mounted on the cylindrical part and which forms part of a reduction unit.

Figure 8:
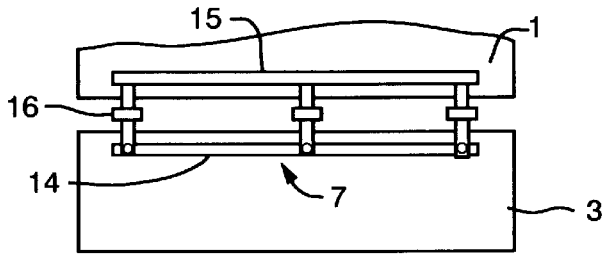
FIG. 8 is a schematic view showing a method for attaching two successive slats.

FIG. 8 shows the architecture of an attachment system (7). The attachment system includes a lower part (14) which is fastened to the top of a non-pivoting part (1) or (3) by any suitable fastener, a non-fastened upper part (15) which is induced to engage with the part (1) or (3) of the lateral slat immediately above it, at the moment of closing, and hinges (16) which primarily serve to permit the slats to match the shape of the drum when the shutters are wound on the upper drum.

Figure 9:
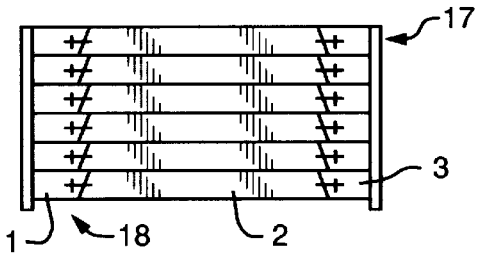
FIG. 9 is an elevational view from the inside of a series of shutters in the closed position.

FIG. 9 shows a view from inside the shutters while in the "closed" position. The drive system (18) has been shown in the figure to indicate its offset relative to the center axis (17) of the central slat (2) (see also FIG. 5), so as to make its pivoting easier. Several variants of these illustrated structures are possible, depending on requirements and technical stresses. For example, the slats may be driven manually, and therefore, without a motor and without an assembly (18). The slats may receive a drive assembly (18) on each side of the central part (2), or one assembly in the part (1) and one assembly in the part (3). The slats may receive a single drive assembly for each slat, with the drive assembly being housed either in the part (1) or in the part (3). The drive system may also be installed or housed in the central part (2). Finally, various combinations between the slats and the drive assemblies may be considered.

Figure 10:
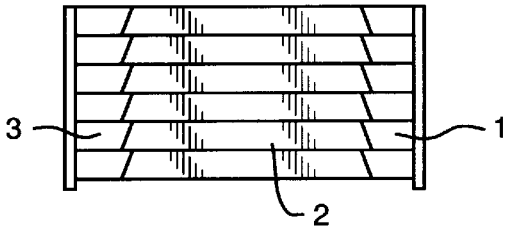
FIG. 10 is an elevational view from the outside of a series of shutters in the closed position.

FIG. 10 shows a view of the shutters from the outside. The oblique lines, although shown in the drawing deliberately, cannot actually be seen.

Figure 11:
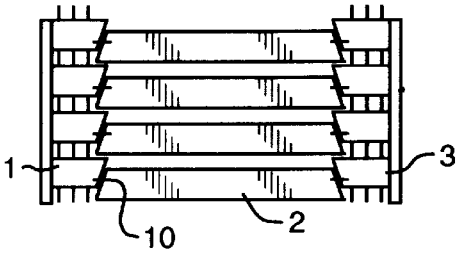
FIG. 11 is an elevational view showing disengagement of the slats before pivoting.

FIG. 11 shows disengagement of the slats, which are pushed by a vertical force coming from the drum responsive to a shutter opening command. In this position, the central parts (2) are completely disengaged and are attached on their center lines by means of the shaft (10), or by means of the attachment assembly of FIG. 8, and are ready to pivot on themselves.

Figure 12:
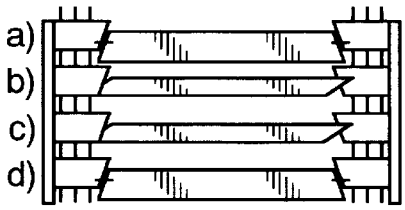
FIG. 12 is an elevational view showing the opening of two of the slats of the shutters of FIG. 11, with the other slats being disengaged.

FIG. 12 shows that only the central parts (2) of two of the slats of a shutter (i.e., the parts in the positions b and c) have been pivoted from a vertical position corresponding to closing to a horizontal position corresponding to opening. Of course, this operation is selected and controlled by means of buttons located on the control box.

Figure 13:
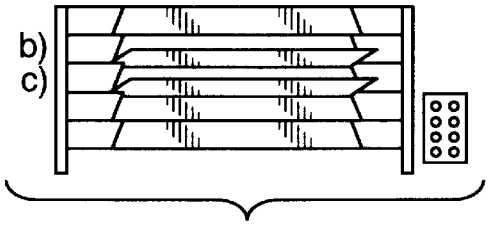
FIG. 13 is an elevational view showing the return of the slats of FIG. 12 which have not been pivoted to the closing position.

FIG. 13 shows that, once pivoting has taken place, all of the other slats resume their initial (closed) position responsive to a shutter closing command. As a result, only the slats in the positions (b) and (c) remain open, whereas all of the other slats are hermetically closed.

Figure 14:
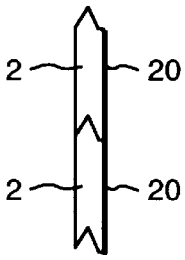
FIG. 14 is a vertical cross-sectional view of slats which have been equipped with a mirror.

FIG. 14 shows two vertically interlocking slats, each of which has a mirror strip (20) fixed on its central part (2). Depending on the effect which is desired, all or only some of the slats may be equipped with mirror strips, or with some other reflecting material. For example, the mirror strips (20) may be replaced by a reflective, adhesive foil material or by some other material having a predetermined reflection factor (e.g., 20%, 30%, ranging from white paint to a fully silvered mirror).

Figure 15:
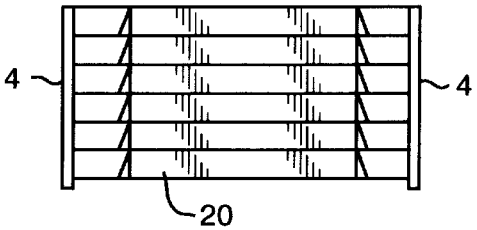
FIG. 15 is an elevational view of a shutter system equipped with a series of mirrors when in the closed position.

FIG. 15 shows the arrangement of the mirror strips (20) when the shutters are closed. In this arrangement, the strips combine to produce a one-piece mirror. This produces a large mirror extending over approximately 80% of the open area of the shutter system, giving an illusion of space and a pleasant view, and making the interior of the set-off space more attractive.

Figure 16:
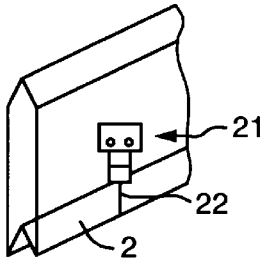
FIG. 16 is an isometric view of a safety switch mounted on a slat.

FIG. 16 shows a safety switch (21) which is located in the middle of the lower side of the central part (2). The switch (21) is equipped with a telescoping rod (22). The contacts of the switch (21) are closed only when the slats are fully and horizontally disengaged. When the switches (21) are closed, the rotors of the corresponding motors are enabled to allow commands to be executed from the control and safety box.

Figure 17:
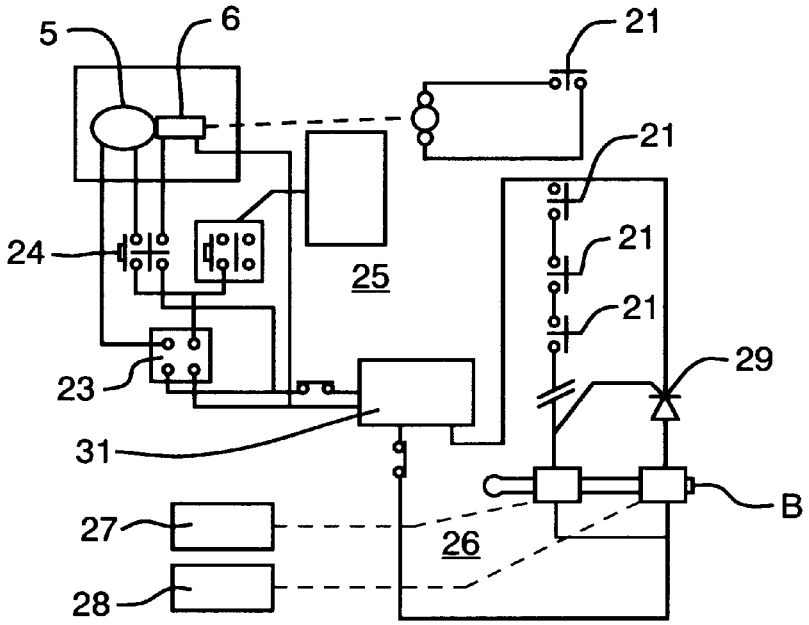
FIG. 17 is an electrical diagram of an example of a control and safety box for operating the shutters of the present invention.

FIG. 17 shows the operating components of a control box including a control assembly (25) and a safety assembly (26). An inverter (23) is provided for reversing the direction of rotation of the motor (5). A control pushbutton (24) serves to control both the motor (5) and the brake (6). It should be noted that this diagram is given merely by way of example, and that there are many possibilities for achieving similar operations. For example, one such variation would be to use two buttons, one for opening and the other for closing, to replace the inverter. To increase the degree of convenience, a plurality of drive systems may be actuated by means of a single pushbutton. Any of a number of variants may be used.

FIG. 17 also shows operations of the safety assembly (26) during opening, when the central parts (2) are still open. For this purpose, an assembly of two electromagnetic coils including an unblocking coil (27) and a blocking coil (28) act on a bolt (B) located on each side of the lowermost slat, which is the slat which touches the bottom of the aperture (e.g., a window) when the shutters are closed.

When the switches (21), which are connected in series, are closed, the unblocking coil (27) is actuated. When a switch (21) is open, the thyristor (29) of the blocking coil (28) becomes conductive and blocking is activated, fastening the lower slat. The switch (21) is located on the shaft (10), which signals (or does not signal) rotation of the motor to the electromagnetic coils. The circuit also includes a transformer/filter/regulator/rectifier assembly, which is within the scope of the person skilled in the art and which is represented in the figure by a functional block (31).

Figure 18:
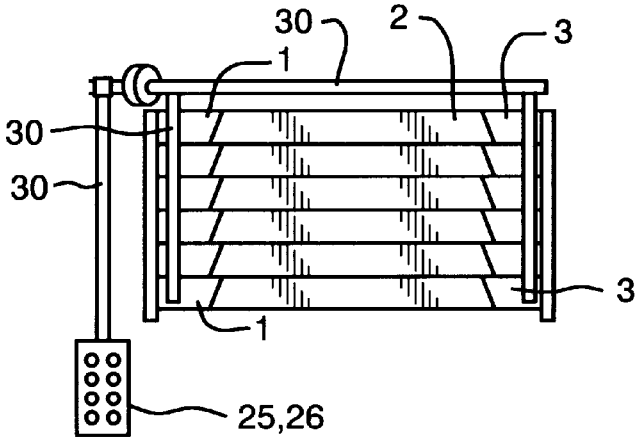
FIG. 18 is a schematic view of an example of a connection between the control box and the slats.

FIG. 18 shows the passage of sleeves (30) from the control and safety box (25, 26) to the drive assemblies in the lateral slats (1 and 3). The junction of the wires in the vicinity of the drum is made using a system for sliding brushes on conductive rings. Other methods may also be implemented.

The following description will illustrate operations of the foregoing shutter system. For this, let it be assumed that the shutters are initially closed. To open one or more of the slats, it is sufficient to partially raise the shutters to obtain a configuration similar to that shown in FIG. 11. It should be noted that this movement can be automated on command. The safety switch (21) located in the central part (2) is then closed, making it possible to execute pivoting commands. It is then sufficient to rotate the motor (a single motor) of at least one of the slats, without thereby adjusting its angle of rotation. This command activates both a release of the brakes and a rotation of the motor. The system for blocking the lower slat is then actuated, which is caused by the pivoting of the central part (2) of one of the slats and by the opening of its switch (21).

To subsequently carry out the closing of the shutters, the switches (21) of the slats which have not been rotated are returned to the position for inhibiting pivoting action. For those slats which have pivoted, the motor is allowed to rotate. This results, as is desired, in convenience in the adjustment of the angle of rotation of the slats while the shutters are in the closed position.

The blocking system remains activated since at least one of the slats has rotated (or a few of the slats have rotated), thus breaking the circuit comprised of the switches (21) which are connected in series in the parts (1 or 3) shown in FIG. 17. The operation can then again commence from the start, for the purpose of opening other slats. The slats are then merely disengaged (no longer interlocked), and the shutters are not capable of being opened. An appropriate amount of time necessary for setting the angle of rotation should be taken, thereby adjusting the internal lighting which is required.

To open the shutters, the motor is activated in order to space the slats slightly (as described above), and to then close the central parts (2). When the central parts (2) close, the unblocking coil (27) is then activated, freeing the lower slat in order to allow the shutters to open. The shutters are then either completely or partially opened, as desired. A second embodiment of the invention, which uses a wire-type pivoting system, is described below by way of nonlimiting example with reference to FIGS. 22 and 23.

Figure 19:
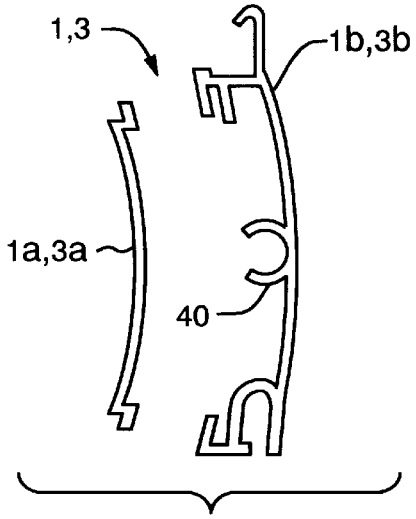
FIG. 19 is a vertical cross-sectional view of the fixed lateral part of a second embodiment of the slat of the present invention.
Figure 20:
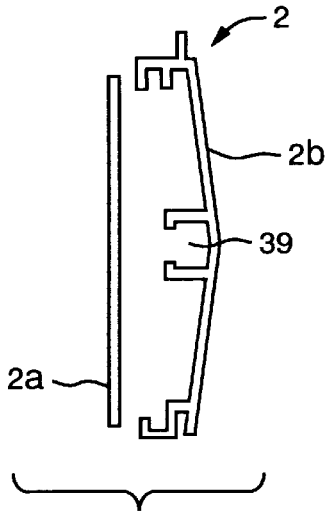
FIG. 20 is a vertical cross-sectional view of the pivoting central part for the second embodiment of the slat of the present invention.
Figure 21:
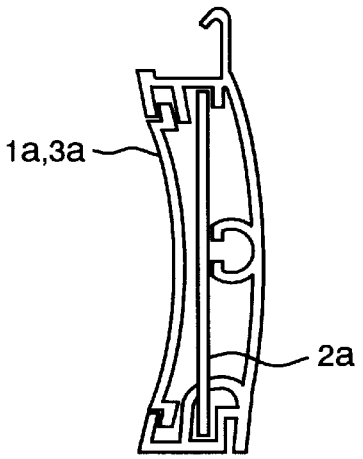
FIG. 21 is a side view of an assembled slat, showing the relative positions and shapes of the central and lateral parts.

FIGS. 19, 20 and 21 respectively show a nonpivoting lateral part (1, 3), a pivoting central part (2) and a mounted assembly for joining the parts (1, 2, 3). The slats are of a conventional type, made of plastic or of metal. Each of the slats has, on the interior side, a sliding part **(1*a*–3*a*) or (2*a*) which closes the web (1*b*, 2*b*, 3*b*) of the slat. A particular feature of this embodiment is the greater thickness of the lateral parts (1, 3) and the curved shape of the sliding parts (1*a*, 3*a*)**, making it possible for the sheet of slats to be wound onto the drum of the roller-type shutter.

Figure 22:
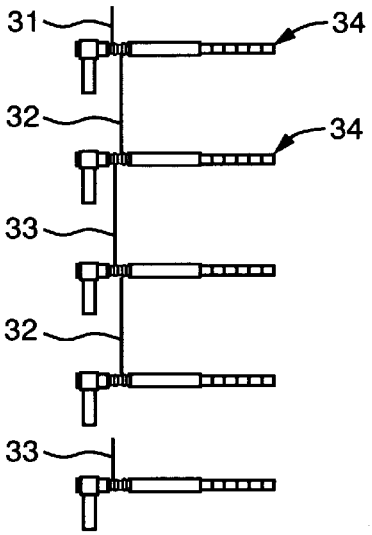
FIG. 22 is a partial elevational view showing a manual system for operating the slats of the second embodiment of the present invention.

FIG. 22 shows a wire-type drive system for operating a set of slats which are each mounted on a shaft (34). A primary wire (31) connects the upper shaft to the control system of the roller-type shutter, and secondary wires (32) connect two successive shafts to one another and are driven by the primary wire. Another primary wire (33) controls a second set of slats, which are not shown in their entirety. The primary wires may be controlled manually or by a motor.

Figure 23:
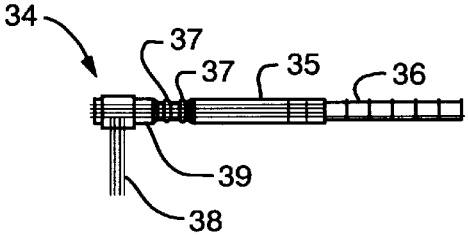
FIG. 23 is an enlarged, partial view of a pivot shaft for the slats shown in FIG. 22.

As is shown in FIG. 23, the shaft (34) includes a part (36) having, for example, a square cross-section, which penetrates into a receptacle (39) having a corresponding shape provided in the central part **(2*b*) shown in FIG. 20. A cylindrical part (35) passes completely through the lateral part (1*b*) or the part (3*b*) in its receptacle (40). The shaft (34) is extended by two pulleys (37) in order to cooperate with the control wires (31) or (32), and by a safety stop (38). If some of the slats are inclined at the moment when the shutters are to be wound up, the bearing contact of the stop (38) makes it possible to automatically return the inclined slats to the vertical position before being wound onto the drum. A reference mark (39)** indicates whether or not the slat is in an inclined position.

What is claimed is:

1. An opening and closing device for use with a system for protecting a building space, comprising:

a plurality of slats slidingly received in two laterally positioned, substantially vertical guides, wherein at least some of the slats include a pivotable part having a face which is covered by a reflective material, and drive means for selectively pivoting the pivotable parts of the slats having the pivotable parts; and wherein the slats are attached to one another by an attachment assembly having a defined height and an interlocking configuration which extends along the length of the slats so that the system is capable of being lowered to a closed position in which a lowermost slat rests on a horizontal surface and in which the slats are all interlocked with one another over their entire length to form a continuous sheet, for enclosing the space, and raised to a partially or a completely open position in which the slats are disengaged and separated from one another by a space defined by the height of the attachment assembly, for opening the space.

2. The device of claim 1 wherein the system for protecting the building space is a roller-type shutter for a window.

3. The device of claim 1 wherein the slats interlock with one another and disengage and separate from one another by gravity.

4. The device of claim 1 wherein the interlocking configuration includes cooperating male and female interlocking shapes.

5. The device of claim 1 wherein each of the slats includes a mirror strip fixed to the face of the pivotable part.

6. The device of claim 1 wherein each of the slats has three parts including two laterally positioned, substantially vertical, nonpivoting parts having one end which is vertically received in the guides, and a central part capable of pivoting about a horizontal shaft connecting the central part and the lateral parts, between a vertical position and an inclined position.

7. The device of claim 6 wherein one end of the horizontal shaft is fastened in a slat body and another end of the horizontal shaft is vertically movable relative to another slat body over a predetermined height, for developing a vertical offset between the nonpivoting parts and the pivoting part during pivoting of the pivoting part.

8. The device of 7 wherein each of the slats includes at least one motorized drive system housed in the slat.

9. The device of claim 8 wherein the motorized drive system includes an electric motor, an electromagnetic brake, and a stress reduction system.

10. The device of claim 7 wherein the horizontal shaft of the central part of each of the slats is offset by a distance measured from a horizontal axis longitudinally extending along the slat.

11. The device of claim 10 wherein the horizontal shaft includes a hollow cylindrical portion and of a flat portion engaged with the hollow cylindrical portion.

12. The device of claim 7 wherein the nonpivoting parts and the pivoting part of each slat have a trapezoidal shape.

13. The device of claim 7 wherein the attachment assembly includes a lower part fastened to top portions of one of the nonpivoting parts of a first slat, an upper part for engaging the nonpivoting part of a second slat immediately above the first slat, and a hinge connecting the lower part and the upper part.

14. The device of claim 7 wherein each of the slats includes a safety switch positioned along a lower part of the slat, and wherein the safety switch includes a telescoping operating rod.

15. The device of claim 14 wherein the safety switches for the slats are connected in series so that when the safety switches are closed, a first coil is actuated for unblocking a bolt located on the lowermost slat, and so that when one of the safety switches is opened, a second coil is actuated for blocking the bolt.

16. The device of claim 1 wherein the slats having the rotatable parts are separately rotatable.

17. The device of claim 1 wherein each of the slats has three parts including two laterally positioned, substantially vertical, nonpivoting parts, and a central part capable of pivoting about horizontal shafts connecting the central part and the lateral parts, between a vertical position and an inclined position, and wherein the lateral parts have a thickness, the central part carrying the reflective material has a thickness, and the thickness of the lateral parts is greater than the thickness of the central part.

18. The device of claim 17 wherein the lateral parts have an inner face which is curved, and wherein the central part has an inner face which is planar.

19. The device of claim 17 wherein each of the horizontal shafts includes a first portion for driving the central part of the slat, a second portion for passing through one of the lateral parts of the slat, and cooperating drive pulleys.

20. The device of claim 19 wherein the horizontal shaft further includes a safety stop.

* * * * *